US005331860A

United States Patent [19]

Demoule et al.

[11] Patent Number: 5,331,860

[45] Date of Patent: Jul. 26, 1994

[54] THROW LIMITING DEVICE FOR A STARTER HEAD OF AN INTERNAL COMBUSTION ENGINE

[75] Inventors: André Demoule, Diemoz; Hugues Pawlik, Lyons; Christian Mornieux, Oullins, all of France

[73] Assignee: Valeo Systems D'Essuyage, Montigny-le-Bretonneux, France

[21] Appl. No.: 3,797

[22] Filed: Jan. 13, 1993

[30] Foreign Application Priority Data

Jan. 13, 1992 [FR] France ..... 92 00245

[51] Int. Cl.[5] ..... F02N 15/00

[52] U.S. Cl. ..... 74/7 R; 74/7 A; 403/DIG. 7

[58] Field of Search ..... 74/6, 7 R, 7 A, 7 B, 74/7 C; 290/38 R, 48; 192/109 R; 403/DIG. 7

[56] References Cited

U.S. PATENT DOCUMENTS

| | | | |
|---|---|---|---|
| 2,526,415 | 10/1950 | Refsdal | 403/DIG. 7 |
| 4,886,306 | 12/1989 | Tanaka et al. | 290/48 |
| 4,916,958 | 4/1990 | Okamoto et al. | 74/7 R X |
| 4,995,275 | 2/1991 | Okamoto et al. | 74/7 A |
| 5,000,054 | 3/1991 | Morishita et al. | 74/7 R X |
| 5,101,114 | 3/1992 | Isozumi et al. | 74/7 A X |
| 5,197,342 | 3/1993 | Nakagawa | 74/7 A |

FOREIGN PATENT DOCUMENTS

| | | | |
|---|---|---|---|
| 2622641 | 5/1989 | France . | |
| 63-295860 | 12/1988 | Japan | 74/7 R |
| 128049 | 4/1950 | Switzerland | 403/DIG. 7 |

*Primary Examiner*—Leslie A. Braun
*Assistant Examiner*—David W. Laub
*Attorney, Agent, or Firm*—Morgan & Finnegan

[57] ABSTRACT

A starter head for the starter of an internal combustion engine includes a motor shaft, on which a starter pinion is mounted for axial sliding movement. A free wheel and a driving sleeve are secured on the starter pinion by means of a securing shroud. The starter pinion has a bore over the whole of its length, with the motor shaft being displaceable within this bore. The starter has a device for limiting the axial throw of the starter head. The throw limiting device comprises a stop ring cooperating with a further ring fixed on the free end of the engine shaft within the bore of the pinion. The stop ring is fitted in a semicylindrical groove formed in the bore.

2 Claims, 2 Drawing Sheets

THROW LIMITING DEVICE FOR A STARTER HEAD OF AN INTERNAL COMBUSTION ENGINE

FIELD OF THE INVENTION

The present invention relates to starters for internal combustion engines, and in particular to a throw limiting device for limiting the axial throw of the starter head, including the starter pinion, of the starter.

BACKGROUND OF THE INVENTION

A starter head comprises a starter pinion which is displaceable axially on a motor shaft until it comes into mesh with a toothed crown carried by the engine flywheel. A free wheel and a driving sleeve are associated with the starter pinion, to which they are secured by means of a shroud. The driving sleeve includes at one of its ends helical splines which cooperate with further helical splines formed on the motor shaft, so that the whole of the starter head is rotatable with respect to the motor shaft.

The axial displacement, or throw, of the head is limited by a throw limiting device, which generally comprises a ring carried on the free end of the motor shaft by the side of the toothed crown which cooperates with the end of the starter pinion in the working position, that is to say in the position in which the pinion is in mesh with the toothed crown. A configuration of this type requires a portion of the motor shaft to project beyond the starter pinion, and even to project out of the casing of the starter assembly itself. This makes it both difficult and costly to provide an effective protection for the projecting portion of the motor shaft against foreign matter and/or other mechanical influences in the environment in which the starter has to operate.

In order to overcome this drawback, a throw limiting device is incorporated in the starter head. This throw limiting device generally operates by cooperation of the ends of the helical grooves formed on the driving sleeve of the head and the motor shaft. The disadvantages of such a device become evident on fitting the starter head on to the motor shaft.

In this connection, the head itself is no longer a simple assembly which can be fitted on the motor shaft, the rear portion of which has previously been fitted with the armature of the electric starter motor. It is therefore necessary in practice to introduce the driving sleeve of the starter head through this rear portion, the motor armature then being assembled on the shaft, and the various components of the starter head being finally assembled in situ. It is practically impossible to carry out such a manufacturing process automatically, with the result that assembly of the starter involves major additional costs.

DISCUSSION OF THE INVENTION

An object of the present invention is to overcome the avove mentioned drawbacks.

According to the invention, a throw limiting device for a starter head for an internal combustion engine, comprising in particular a motor shaft, on which a starter pinion is mounted for sliding movement, the starter pinion being fixed to a free wheel and a driving sleeve by means of a shroud, the starter pinion having over the whole of its length a bore within which the motor shaft is displaceable, is characterised in that a stop ring is fitted in a semicylindrical groove formed in the said bore, with the said stop ring cooperating with a further ring which is fixed on the end of the motor shaft.

According to a preferred feature of the invention, the throw limiting device includes a closure cap which defines, with the said further ring, a space or zone within the said bore, and in that the device further includes circulation means for circulation of the air contained in the said zone, the circulation means being disposed between the said zone and the rear end of the starter pinion.

According to another preferred feature of the invention, the said circulation means comprise longitudinal grooves formed on the periphery of a cylindrical collar carried by the said further ring.

According to a further preferred feature of the invention, the said circulation means include longitudinal grooves formed in the said bore of the starter pinion.

The invention will be more clearly understood on a reading of the description of a preferred embodiment of the invention which follows, and which is given by way of example only and with reference to the accompanying drawings.

DESCRIPTION OF A PREFERRED EMBODIMENT OF THE INVENTION

Figure 1:
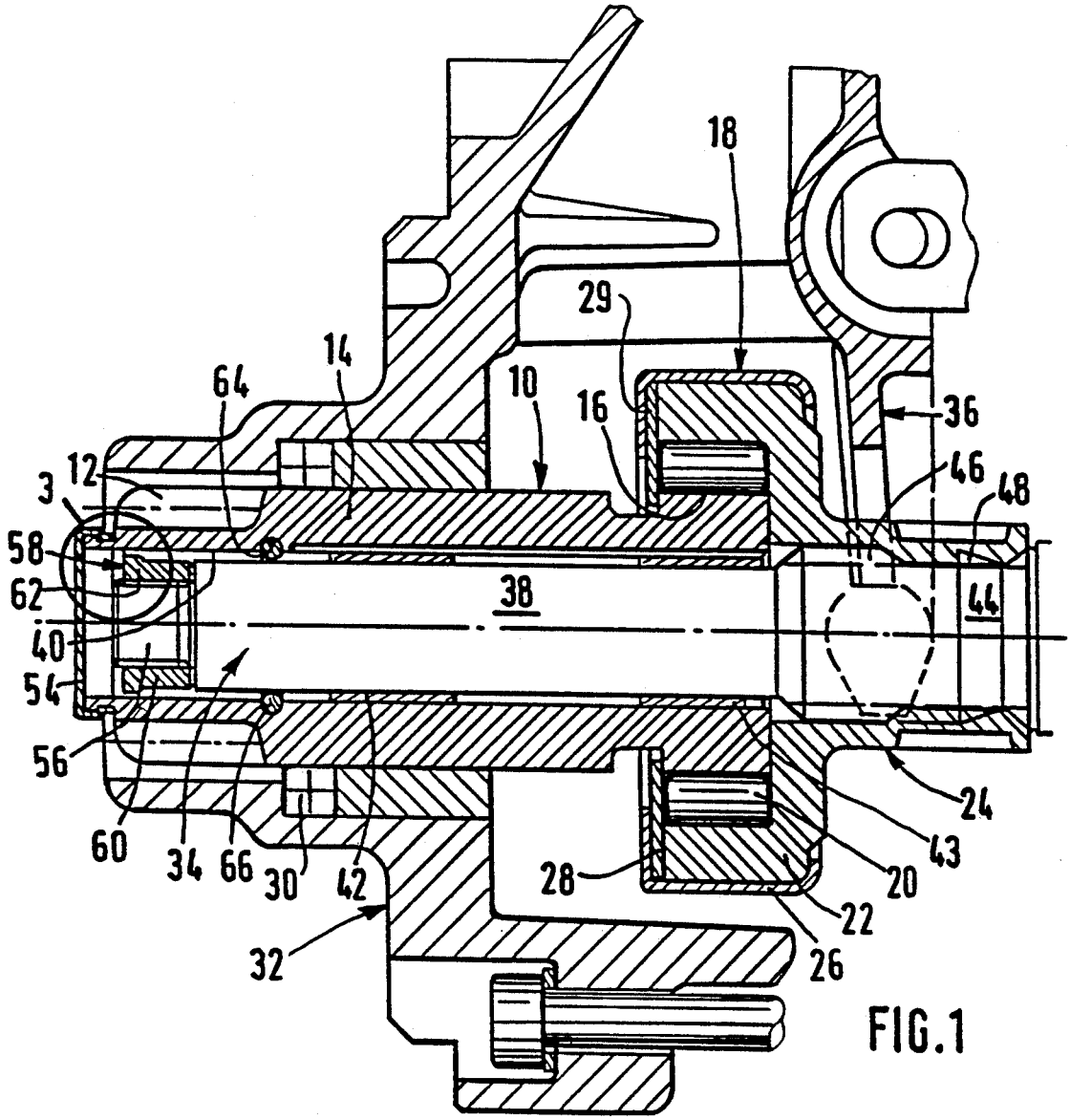
FIG. 1 is a view in cross section of part of a starter head in a rest position, having a throw limiting device in accordance with the invention.

A starter head consists of a starter pinion 10, one end 12 of which includes a toothed crown 12 which is arranged to mesh with another toothed crown carried on the engine flywheel (not shown). The toothed crown 12 is extended by a cylindrical portion 14. The end of the cylindrical portion 14 which is remote from the end carrying the toothed crown 12 constitutes the track 16 of a free wheel 18, the essential component of which is a set of inserted rollers 20. In the example shown, the cage of the free wheel 18 consists of one end portion 22 of the driving sleeve 24.

A shroud 26 is fitted around the periphery of the end portion 22, so as to secure together the starter pinion 10, the driving sleeve 24 and the free wheel 18. The shroud 26 retains in position two half rings 28 and 29 in the usual way, thus closing and sealing the free wheel 18. The starter head assembly itself is guided in rotation by means of a ball bearing 30, which is mounted within one end portion 32 of the casing of the starter.

Figure 2:
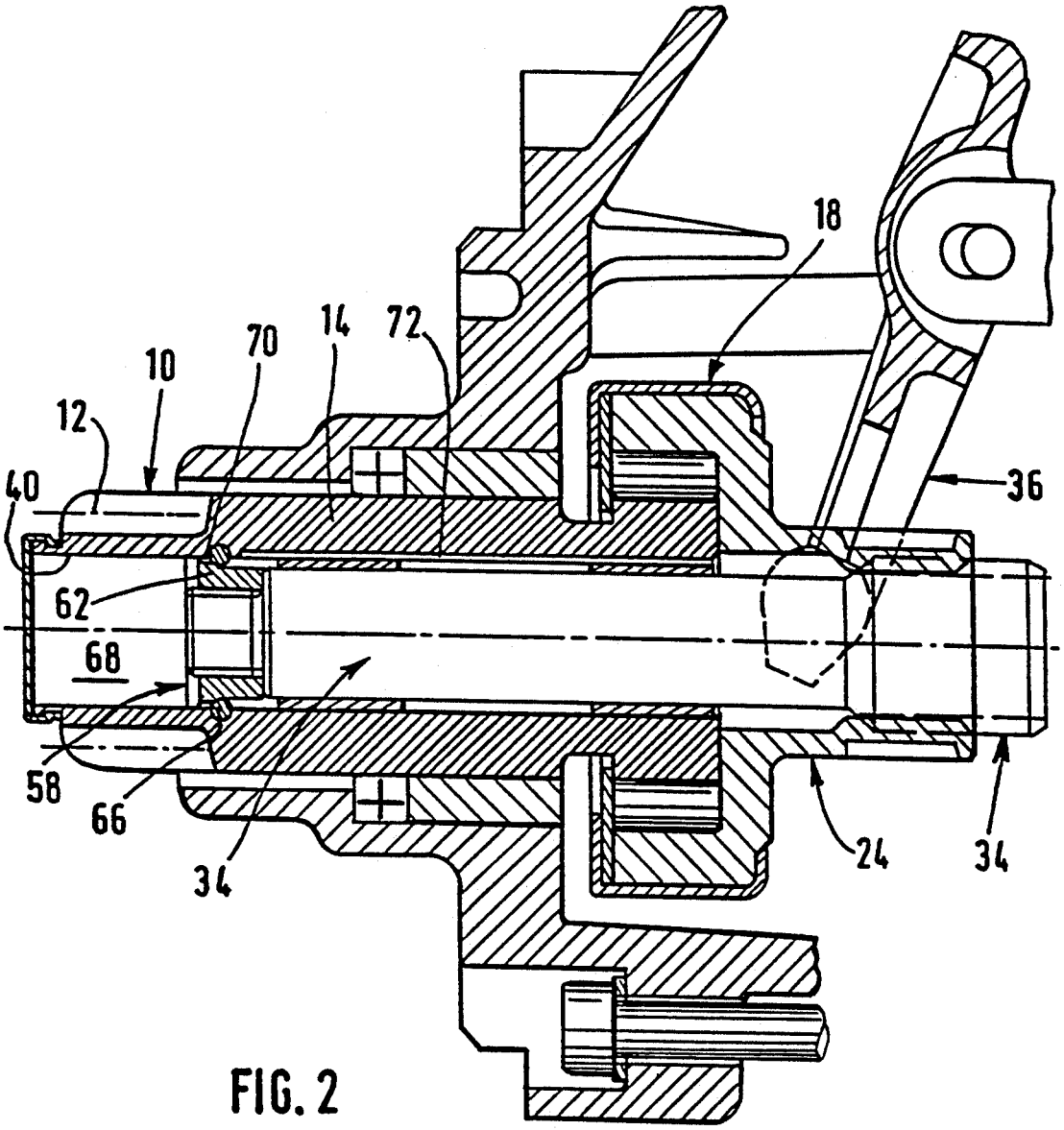
FIG. 2 is a view identical to FIG. 1 but with the starter head in a working position.

The starter head is of course mounted for sliding movement with respect to a motor shaft 34, so that it can be displaced between a rest position shown in FIG. 1 and a working position shown in FIG. 2, in which the starter pinion 10 is meshed with the toothed crown, not shown, on the engine flywheel. This displacement (in straight line movement) takes place in the usual way, being actuated by the pivoting movement of a lever 36. For this purpose the motor shaft 34 has a first cylindrical surface 38 which fits within a central bore 40 of the starter pinion 10. Sliding bearing sleeves 42 and 43 enable the starter pinion to slide axially on, and rotate around and with, the motor shaft 34.

Adjacent to the first cylindrical surface 38, the motor shaft 34 has a second cylindrical surface 44, of larger diameter than the surface 38, at the outer periphery of which are formed helical splines 46 for cooperation with a further set of helical splines 48 formed in a bore which is situated in the rear or trailing portion of the driving sleeve 24.

Figure 3:
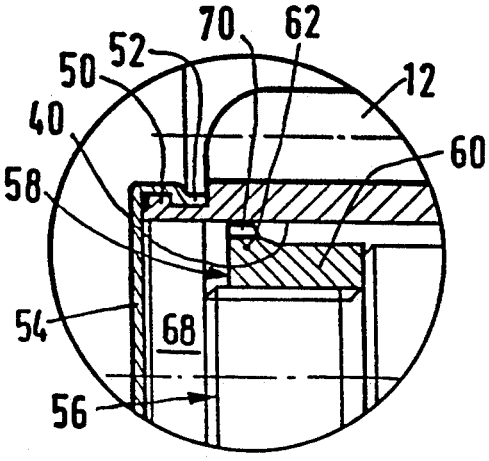
FIG. 3 is a view on a larger scale showing a leading part of the starter head.

The leading or front end of the toothed crown 12 of the starter pinion 10 is extended by a cylindrical sleeve portion 50 which is formed with an annular groove 52, best seen in FIG. 3. A closure cap 54 is snap-fitted into the groove 52 so as to cover the open end of the central bore 40 and thus provide protection, especially for the motor shaft 34, against ingress of any foreign matter from outside.

The front or leading end of the motor shaft 34 is extended by a threaded boss 56. A ring 58, which is screwed on to the boss 56, has a cylindrical rear portion 60 of the same diameter as the first cylindrical surface 38 of the motor shaft 34. The front part of the ring 58 is formed with a cylindrical collar 62, having an external diameter which is equal to the diameter of the bore 40 of the starter pinion 10. This bore 40 is formed with a semicylindrical groove 64, in which a stop ring 66 is fitted. This stop ring 66 is thus fixed to the starter pinion for longitudinal or translational movement with the latter.

When the starter head, impelled by the lever 36, moves from its rest position shown in FIG. 1 to a working position as shown in FIG. 2, the stop ring 66 slides on the first cylindrical surface 38 of the engine shaft 34 until it comes into contact with the cylindrical collar 62 of the ring 58. The stop ring 66 and the ring 58 thus constitute the throw limiting device of the starter head, this throw limiting device being situated within the starter pinion 10. As a result, the motor shaft 34 does not project, and is thus fully protected whatever the position of the starter head.

When the starter head moves from its working position to its rest position, that is to say when the starter pinion 10 is displaced from left to right in the drawings, the air which is contained in the zone 68 lying between the closure cap 54 and the ring 58 is suddenly compressed. In order that this compression will not cause the closure cap 54 to be dislodged by the resulting reaction force, air circulation means are provided to allow the air contained in the zone 68 to circulate. These means comprise a set of longitudinal grooves 70 which are formed on the periphery of the collar 62 of the ring 58, so as to bring the zone 68 into communication with another set of longitudinal grooves, 72, formed in the bore 40. These latter grooves 72 extend along the cylindrical portion 14 of the starter pinion 10, and are open at the rear end of the latter. The air which is forced away from the zone 68 is finally evacuated through the helical grooves 46 formed on the motor shaft 34.

The present invention is of course not limited to the embodiment described above and shown in the drawings, but embraces any variant which may be applied to it by a person skilled in the art. In particular, the ring 58 may be secured to the motor shaft 34, for axial movement with the latter, by means of a stop ring. Similarly, the ring 58 may consist of a screw having the same shape, the motor shaft 34 having a threaded hole at its end.

What is claimed is:

1. A starter for an internal combustion engine, comprising a motor shaft having a free end, and a starter head carried by the motor shaft, the starter head having a starter pinion with a first end closer to the free motor shaft end and a second end opposite to the first end; a free wheel carried by the second end of the starter pinion, the free wheel including a driving sleeve; a shroud securing the driving sleeve and the free wheel to the starter pinion, the starter pinion having a bore extending the full length of the pinion, the pinion also having a semicylindrical groove formed in the bore surface thereof, with means in the bore mounting the pinion on the motor shaft for axial sliding throw of the pinion on the motor shaft, the starter further including a throw limiting device having a stop ring fitted in the semicylindrical groove, and a further ring carried on the free end of the motor shaft adjacent the first end of the pinion for cooperation with the stop ring, whereby to limit the axial throw of the pinion; a closure cap carried by the pinion and covering the pinion bore at the first end, the closure cap and further ring together forming a space within the bore, the starter having air circulation means for ciculation of air contained in the space from the space to the pinion second end, between the space and the second end of the starter pinion; the further ring having a cylindrical collar, the collar having peripheral longitudinal grooves formed in the surface thereof, the circulation means including the longitudinal grooves.

2. A starter according to claim 1, wherein the starter pinion has longitudinal grooves in its bore, the circulation means including the longitudinal grooves.

* * * * *